United States Patent [19]

Clark

[11] Patent Number: 4,914,763

[45] Date of Patent: Apr. 10, 1990

[54] NON-TILT THERAPEUTIC PILLOW

[76] Inventor: Randall S. Clark, 6469 Clark Rd., Paradise, Calif. 95969

[21] Appl. No.: 376,227

[22] Filed: Jul. 3, 1989

Related U.S. Application Data

[63] Continuation-in-part of Ser. No. 147,250, Jan. 19, 1988, abandoned.

[51] Int. Cl.[4] ..... A47C 20/00

[52] U.S. Cl. ..... 5/440; 5/434

[58] Field of Search ..... 5/431, 434, 437, 440, 5/442, 446, 447, 462

[56] References Cited

U.S. PATENT DOCUMENTS

| | | | |
|---|---|---|---|
| 2,085,296 | 6/1937 | Carey | 5/434 X |
| 2,700,779 | 2/1955 | Tolkowsky | 5/434 X |
| 3,148,389 | 9/1964 | Lustig | 5/434 X |
| 3,239,854 | 3/1966 | Freedlander | 5/434 |
| 3,284,817 | 11/1966 | Landwirth | 5/431 |
| 3,319,272 | 5/1967 | Eller | 5/436 |
| 3,757,364 | 9/1973 | Downing | 5/436 X |
| 4,256,096 | 3/1981 | Budde | 5/433 X |
| 4,447,922 | 5/1984 | Brochu | 5/434 |
| 4,606,088 | 8/1986 | Michaelsen et al. | 5/434 |
| 4,731,891 | 3/1988 | Scheurer et al. | 5/442 X |
| 4,756,035 | 7/1988 | Beier | 5/437 |
| 4,776,048 | 10/1988 | Wilheim | 5/434 |

*Primary Examiner*—Gary L. Smith
*Assistant Examiner*—Michael J. Milano

[57] ABSTRACT

A therapeutic sleeping pillow having two foam layers of different density is provided on an underside with supporting runners adapted to prevent pillow head tilting and pillow displacement on a bed surface. The composition and height of the pillow provides a cushion particularly useful for supporting the head and neck in alignment with the spine of a person reclining on his or her side.

4 Claims, 5 Drawing Sheets

NON-TILT THERAPEUTIC PILLOW

BACKGROUND OF THE INVENTION

This is a continuation-in-part of Ser. No. 07/147,250 filed 01/19/88 now abandoned.

1. Field of the Invention

This invention relates to therapeutic sleeping pillows and particularly to a therapeutic pillow for relaxing tendons and shoulder muscles during sleep when the sleeping person is laying on his or her side. The immediate invention is primarily directed towards position retaining and the prevention of tilt-up at either end and from having an edge raise when the weight of the sleeper's head is shifted on the pillow.

2. Description of the Prior Art

Many attempts have been made to produce a therapeutic sleeping pillow which would comfortably elevate a persons head while sleeping in a sidewise position. In these attempts, molded pillows contoured to the head and neck line of the sleeper and pillows grooved to accept hair curlers have been tried. Pillows with dual fillers having a soft top and a harder bottom section appear to be the most effective. This has also been tried without actually accomplishing a satisfactory therapeutic pillow useful for sidewise sleeping. A major problem which is solved by the immediate invention is the tendency for a wide edged pillow to tilt towards from the weight of the sleeper's head. A second problem can also occur when the ends of a pillow both tend to tilt or curl up around the head of a sleeper. Tilting problems are caused in wide edged, foam filled pillows when a soft foam section is used unattached over a hard foam section in the pillow structure, especially when both are encased in a pillow case. When the soft upper section is pushed down by the sleeper's head, the soft section tends to flip up above the sleeper's head pulling the hard section with it. This same effect also tends to pull up both ends of the encased pillow. To provide sidewise sleeping with the head elevated to keep the spine aligned requires a wide edged pillow. My testing has shown the wide edged two-sectioned pillow, a soft foam block upper section unattached over a harder foam block lower section, provides the best therapeutic sleeping pillow, relaxing both tendons and shoulder muscles. The two sections, incased in a special covering and then a pillow case, must be left unattached so that one section, preferably the soft section, can be changed when changes in the thickness of the pillow are required for different sized sleepers. The problem is to provide a comfortable head rest and to prevent the wide edged pillow from tilting along the edges or actually popping out from under the sleepers head from pressure on a wide edge. This has to be accomplished without inserting bracing between sections of the pillow or providing the pillow with an exceptionally hard base or foam layer unless you're not overly concerned about the neck comfort of the sleeper.

The need for double padding in a pillow for head elevation is seen in several past art devices. The principal drawback to these illustrated pillows appears to be lack of consideration for the sleeper's comfort, difficult pillow height adjustment, and central placement of hard panels or a hard block member which all but eliminates the cushioning effect of the double padding. This hard core center structure is seen in a U.S. patent issued to Beier on July 12, 1988, U.S. Pat. No. 4,756,035. Although Beier approaches the double padding need in one section, the neck section, of his device, he provides a hard core center fitted inside the neck section all but eliminating the cushioning effect of the double padding. This might support a sleeper's neck with some comfort while the sleeper is on his back but would appear to be uncomfortable for the side sleeper. A fold-over pad is seen in U.S. Pat. No. 3,757,364, dated Sept. 11, 1973, granted to Downing. On Downing's pillow, the sleeper has a hollow for his head to rest in while on his back, and raised sides to elevate his head for side sleeping. Downing makes no provisions for pillow height adjustment or for preventing end tilting from the sleeper's head weight and the sleeper must lie in a particular position to take advantage of the head hollow for back sleeping and the raised sides for side sleeping. U.S. Pat. No. 2,700,779, issued to Tolkowsky, dated Feb. 1, 1955, shows similar contouring to the Downing pillow. Although Tolkowsky does call his device a "Therapeutic Pillow," the specifically shaped surface of the pillow and the hardness required to maintain the shape imposes considerable limitations on user comfort. Other U.S. patents noted with raised head provisions included U.S. Pat. Nos. 4,256,096 and 3,319,272.

My invention approaches and solves problems associated with pillow hardness, pillow tilting, pillow height, and the need for a comfortable head support for the person who sleeps on his or her side.

SUMMARY OF THE INVENTION

In practicing my invention, I provide structuring to solve comfort problems, prevent edge tilting, and maintain placement in a therapeutic pillow useful for the back sleeper and particularly comfortable for the person who sleeps primarily on his or her side. To do this, I have fashioned a wide-edged, double-layered, foam sectioned, encased therapeutic sleeping pillow with a simple support which prevents tilting and most pillow displacement on a bed surface. In my device, I provide two solid foam cushions in the form of rectangular, box-like panels placed unattached one above the other in a flexible soft cover encasement. The upper foam cushion section is of a soft resilient material and for descriptive purposes is designate the "soft cushion." The lower foam cushion is harder and of a more resilient material than is the upper cushion. For descriptive purposes, the lower foam cushion is designated "support cushion." The upper cushion, the soft cushion, is replaceable by similar soft cushions of different thicknesses to provide edge wall height adjustment as required for different sized sleepers. The lower cushion, the support cushion, is of a more permanent nature having resilience to maintain a flattened form and is fitted on the bed resting side with special runners which are unique to the immediate invention. The soft cushion is of a firmness to support a human's head and neck depressed to a comfortable degree in the soft material of the upper cushion. The support cushion is of a firmness to limit the degree of depression of the human's head and neck in the upper soft cushion.

In tests made on the device, two strip-like runners were attached lengthwise on the bottom surface of the lower support cushion adjacent outer longitudinal edges. Angling the transverse structure of the runners provided retaining mechanics to keep the pillow positioned on the bed surface and to prevent the pillow tilting along the back edge and at the ends. The best results are obtained by using elongated substantially rectangular flat wooden strips. The strips are wide along a longitudinal outer faced edge, have an upper flat horizontal surface, and a bottom surface angled up to a narrow interfaced edge. The runners are attached to the bottom surface of the lower hard panel approximately an inch from the outer longitudinal edge with the side edges of the runners in longitudinal alignment with the wide edge of the panel. The narrow edges of the runners face each other, and the runners are attached to the bottom surface of the hard foam panel with flat sides up and angled sides down. The runners are shorter than the foam panel leaving end space under the pillow so as not to pinch the sleeper's hand should he or she inadvertently place a hand under the edge of the pillow. When weight is placed on the upper surface of the pillow by a sleeper's head, the lower hard foam support cushion tends to press down in the center pushing the outer edges of the runners downward which has been found to form a sort of braking system holding the pillow in place. The rigidness of the wooden runners tends to prevent the pillow ends from tilting up. The two runners and the braking tends to prevent the upper edge of the pillow from rising, because of weight on the thick wall lower edge, and from popping out from under the sleeper's head.

Therefore, a primary object of the invention is to provide a two section therapeutic pillow with structure to prevent tilting of the ends and head of the pillow.

Another object of the invention is to provide a therapeutic pillow with special runners along a bottom area which angle down when weight is applied to the pillow as a device to help retain the pillow in a particular position on a bed surface.

A further object on my invention is to provide a therapeutic pillow with upper and lower foam panel cushion sections of which one or both can be changed to adjust pillow thickness to the body size requirements of various sleepers.

Other objects and advantages of the instant invention will become clear by reading about the numbered parts described in the remaining specification and comparing them with like numbered parts illustrated in the drawings.

DESCRIPTION OF A PREFERRED EMBODIMENT

Figure 1:
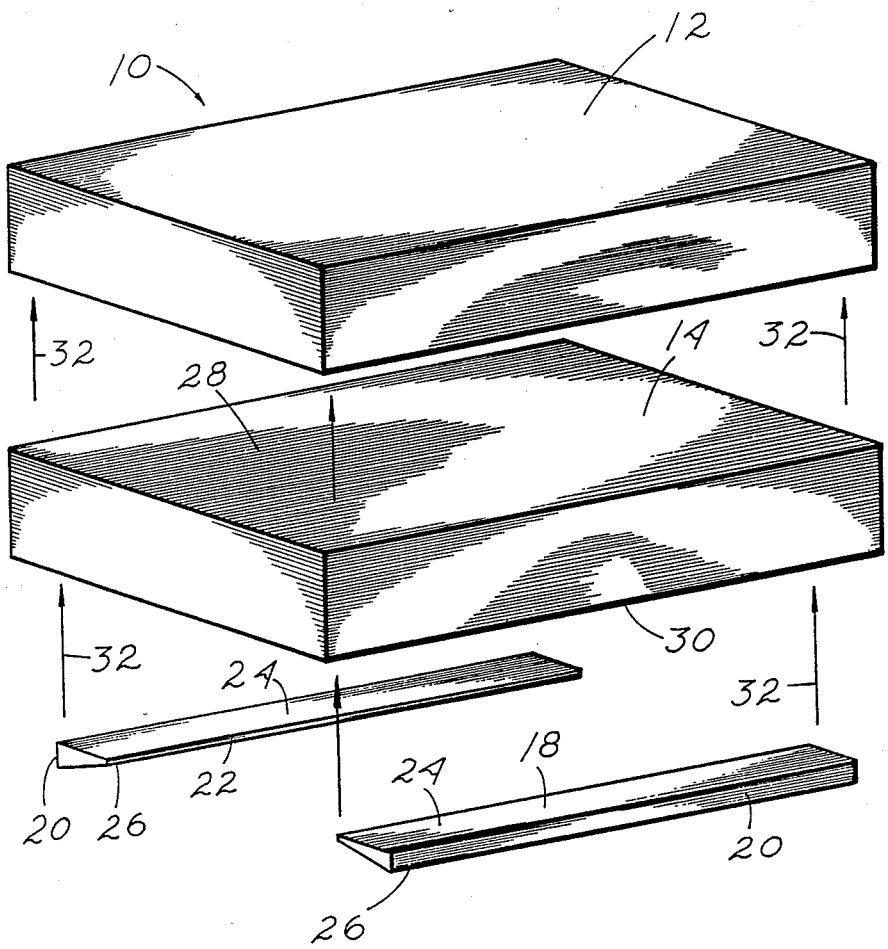
FIG. 1 shows an exploded view of the foam panel-like cushions placed one above the other for assemblage with the angled runners aligned below the lower hard foam cushion panel for attachment on the bottom surface adjacent the longer edges.

Referring now to the drawings where the non-tilt therapeutic pillow according to this invention is illustrated. It should be noted that the pillow constituting the immediate invention is particularly structured to keep the head, neck and spine aligned of a person who likes to or must sleep on his or her side. In the drawings at FIG. 1, the therapeutic pillow assemblage 10 according to the invention is illustrated with dissembled parts positioned for assemblage. The designation 10 generally indicates the pillow assemblage and in FIG. 1, soft cushion 12, generally structured of a soft open cell foam plastic in a panel-like block form, is positioned above support cushion 14, generally structured of a medium soft open cell resilient plastic foam material also in panel-like block form. The block forms of soft cushion 12 and support cushion 14 have matching substantially rectangular wide surfaces top and bottom supported by narrow peripheral walls. The panels are solidly structured of cushioning open cell polyurethane-type materials. The composition of soft cushion 12 is of a soft spongy material sufficiently strengthened to support illustrative sleeper's head 38, See FIG. 3, in a cushioned elevated position. The composition of support cushion 14 is of a denser or more firm material than the material of soft cushion 12 and is resilient in nature tending to return to a remembered position if forcibly displaced. The two cushions, soft cushion 12 and support cushion 14, are designed for placement of soft cushion 12 on top of support cushion top surface 28 and supported by support cushion 14 unattached but maintained together inside a soft material casement, pillow assemblage casement 34, according to directional assemblage indicators 32. Although both soft cushion 12 and support cushion 14 must have matching peripheral boarders, either can be thickened or thinned edgewise to increase or decrease pillow height as required by illustrative sleeper 36, see FIG. 3. As support cushion 14 has attachment to bottom surface 30, it is preferred that only soft cushion 12 be exchangeable for pillow enlargement. However, for some applications, soft cushion 12 and support cushion 14 can be adhered permanently together or manufactured as a one-piece pillow.

Important to the invention as well as unique in supportive action are two longitudinal runners, first runner 16, and second runner 18. Longitudinal runners 16 and 18 are attached to support cushion 14 on support cushion bottom surface 30 adjacent both longitudinal edges. Longitudinal runners 16 and 18 are elongated rectangular strips, preferably wood, each having a wide longitudinal edge 20, an upper flat runner surface 24 and a lower angled runner surface 26. Lower angled runner surface 26 is angled transversely upwardly from wide longitudinal runner edge 20 to narrow longitudinal edge 22. The length of both runners, 16 and 18, is limited at a terminal point relative to the end of support cushion 14 to provide free end areas 46, an unsupported end area of support cushion bottom surface 30. Free end areas 46 are provided to prevent illustrative sleeper 36 from getting her fingers pinched should she inadvertently place a hand under the edge of pillow assembly 10 as so many sleeping persons often do.

Figure 5:
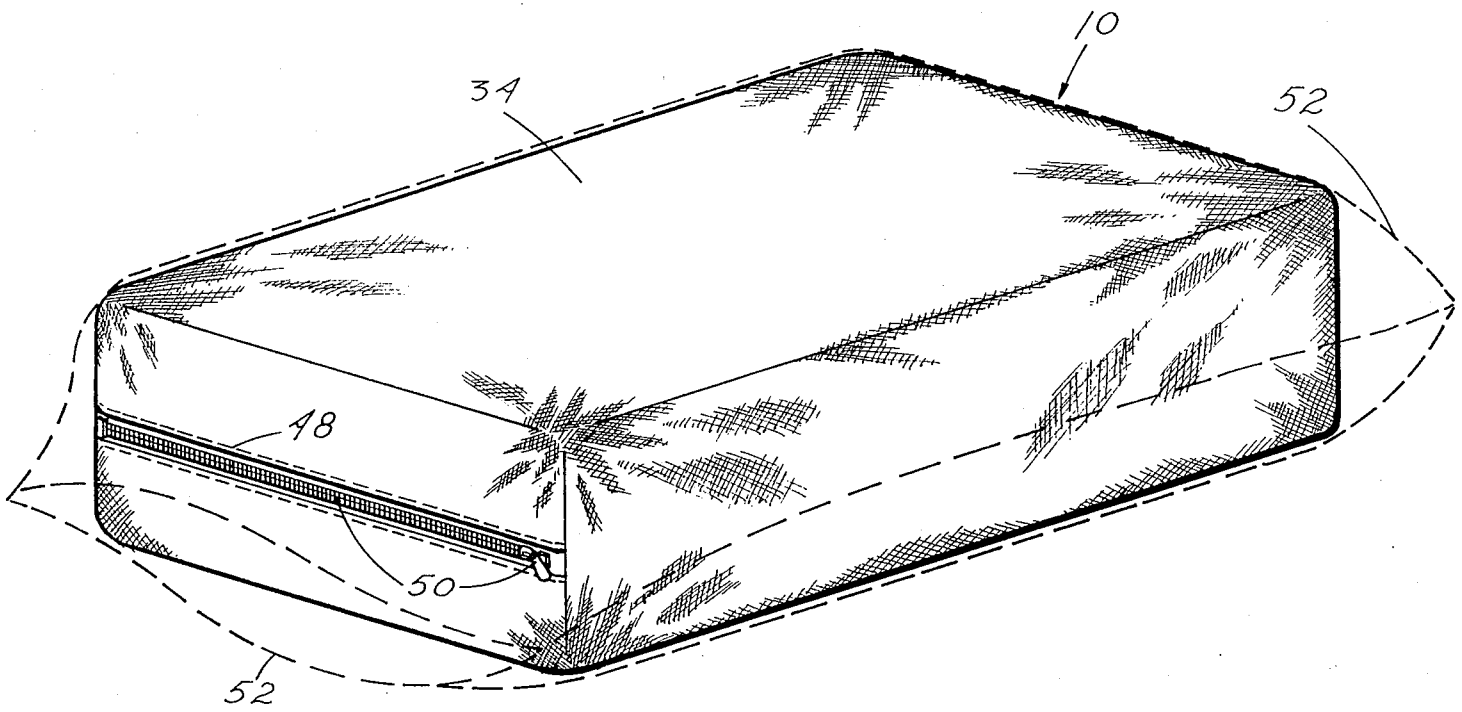
FIG. 5 is a perspective view of the encased pillow showing the special pliable soft covering in which the sections of the pillow are removably retained. Thus covered, the pillow is ready to be inserted into a pillow case illustrated by dotted lines.

With all parts of pillow assembly 10 together, pillow assembly 10 is contained in a soft covering encasement, pillow assemblage casement 34. The parts of pillow assembly 10 can be inserted or removed through casement interior access opening 48 and the opening can be temporarily retained closed by casement access opening and closing fixture 50, a zipper or similar closure. With pillow assembly 10 inside, pillow assemblage casement 34 can be inserted into pillow case 52, the same as any other bed pillow. See FIG. 5.

Figure 2:
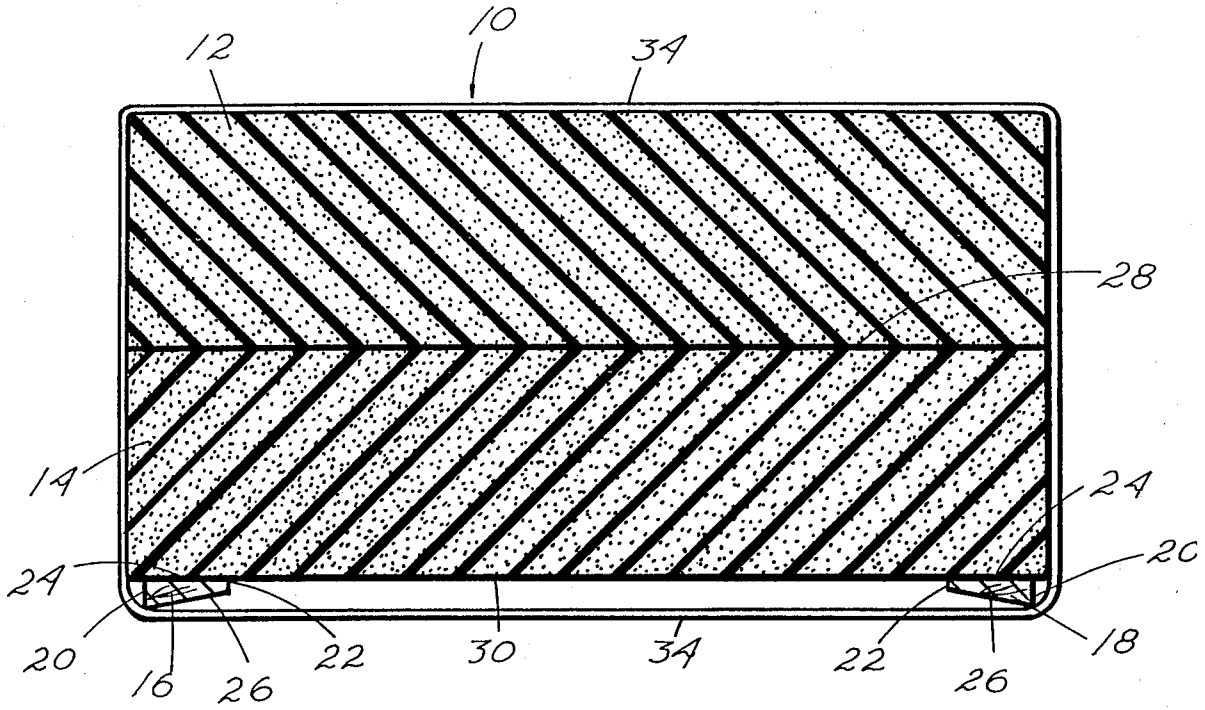
FIG. 2 is a sectional end view of the encased pillow showing the upper soft cushion resting on top of the lower support cushion with the ends of the runners visible adjacent the ends of the lower support cushion.
Figure 3:
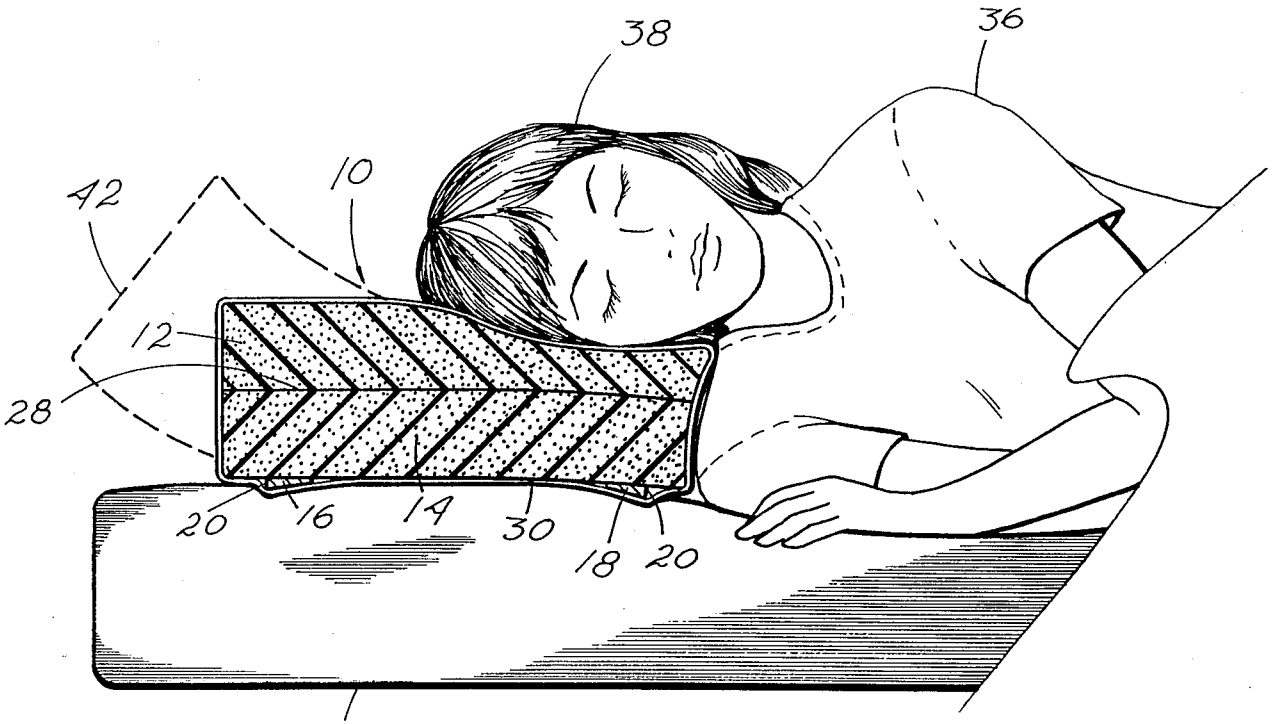
FIG. 3 shows a person sleeping on the pillow with the pillow sectioned at the end to illustrate the edges of the runners compressed into the bed surface providing braking for the pillow and preventing head tilting illustrated by dotted lines.
Figure 4:
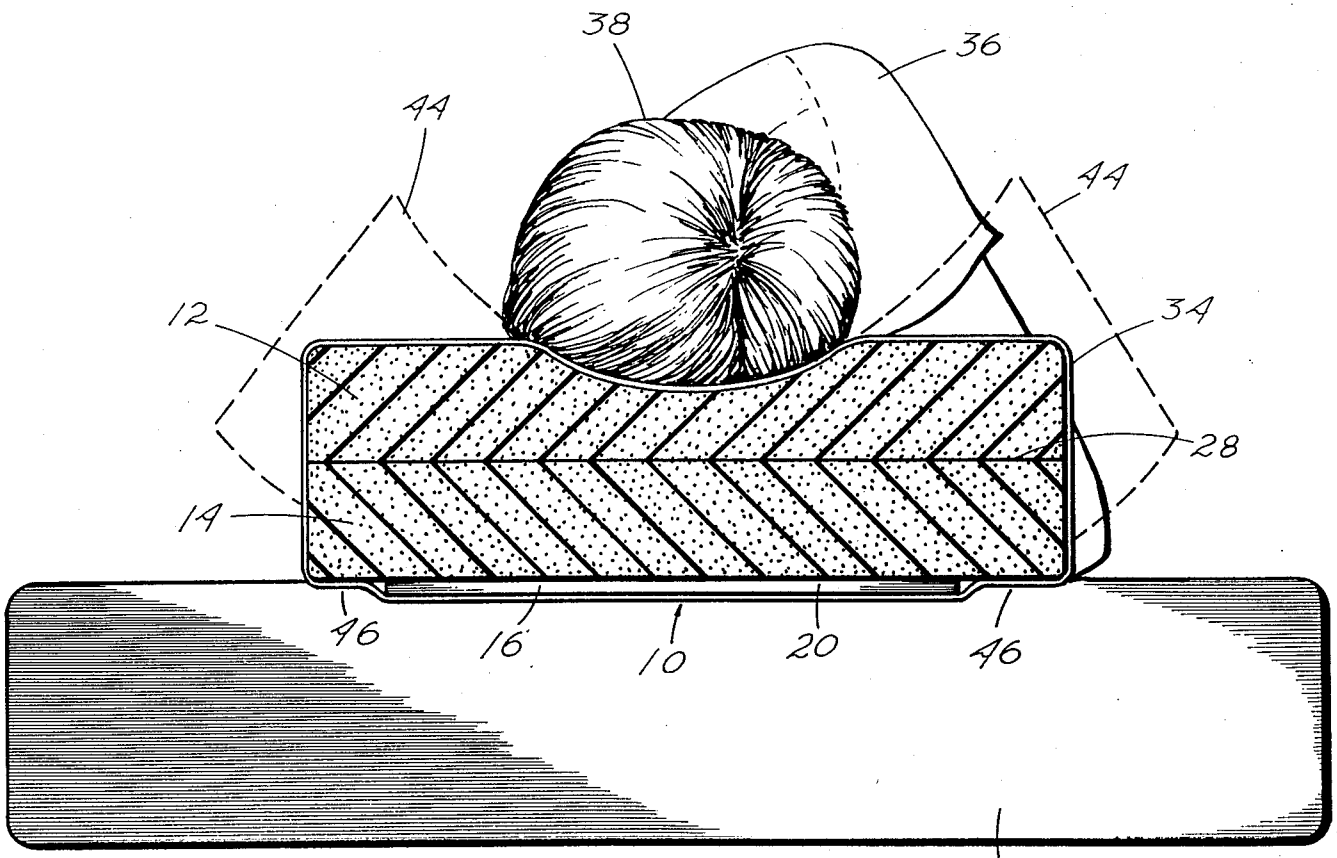
FIG. 4 is a view from the top of the sleeper's head and of the pillow lengthwise sectioned illustrating the functioning of the longitudinal runners in preventing end wrap up or end tilting of the pillow during use. The prevented wrapping up is illustrated by dotted lines.

Those skilled in the art should have no difficulty understanding structuring of the present invention as sectionally shown in FIGS. 2, 3, and 4. The sectioned end view in FIG. 2 shows the solidly formed soft pliable plastic foam structure of soft cushion 12 resting on top of the more resilient, denser plastic foam structure of support cushion 14. The ends of first runner 16 and second runner 18 can be seen at either lower end where the two runners are affixed to the support cushion bottom surface 30 of support cushion 14. The upper flat runner surfaces 24 are affixed to the support cushion bottom surface 30 with their wide longitudinal edges 20 faced outward and their narrow longitudinal edges 22 faced towards each other. In the FIG. 2 illustration a space can be seen between the lower surface of pillow assemblage casement 34 and support cushion bottom surface 30. In FIG. 3, when the weight of the illustrative sleeper's head 38 is on pillow assemblage 10, it can be seen how the space between pillow assemblage casement 34 and support cushion bottom 30 has been pushed up by the surface of mattress 40 of the bed. Wide longitudinal runner edge 20 of first runner 16 has been pressed down into mattress 40 as has wide longitudinal runner edge 20 of second runner 18. Pressed down in this manner, runners 16 and 18 tend to provide brakeage preventing pillow assemblage 10 from easily sliding along the top surface of mattress 40. The more solid and resilient structure of support cushion 14 plus runners 16 and 18 tend to prevent pillow assemblage 10 from tilting up as illustrated in dotted line, illustrative pillow head tilt 42, and from popping out from under illustrative sleeper's head 38 when illustrative sleeper 36 moves. Wide edge foam structured pillows, unfortunately, have a tendency to tilt up and even pop out from under a sleepers' head 38 which is a bothersome trait especially in pillows designed for therapeutic use. Foam structured pillows also have a tendency to tilt up or curl up at the ends when pressure is exerted in the center. See illustration at FIG. 4. The pillow assemblage 10 according to the immediate invention is designed to restrict both head tilting, FIG. 3, illustrative pillow head tilt 42, and end tilting or end curl up, FIG. 4, illustrative pillow end tilt 44.

Although I have described an embodiment of my therapeutic pillow with considerable details in the foregoing specification, it appears obvious that one skilled in the art could modify my structure and still accomplish the end results accomplished by the form of the immediate invention as described, I, therefore, reserve the right to make modifications to the invention under patent protection so long as any modifications made remain within the intended scope of the appended claims.

I claim:

1. A therapeutic pillow for use in a bed adapted to support a human's head and neck in general alignment with said human's spine with said human positioned on his side, said pillow further adapted to restrict tilting and displacement of said pillow on said bed, comprising:

a cushion having a generally flat first side manufactured of soft resilient plastic foam;

said cushion having a generally flat second side oppositely disposed from said first side manufactured of a more firm resilient plastic foam than said first side, said second side adapted for downward placement against said bed;

a first runner;

a second runner said runner attached to said second side adjacent and in general parallel alignment with one edge of said second side, said second runner affixed to said second side adjacent and in general parallel alignment with an oppositely disposed edge of said second side from that of said first runner;

said first and said second runners being of rigid structure adapted to cause said restriction of tilting and displacement of said pillow on said bed during use;

said soft first side of said cushion adapted to support said human's head and neck depressed to a comfortable degree in said cushion;

said cushion and both said runners being encased with a covering of soft, pliable material;

said second side of said cushion adapted to limit said degree of depression of said human's head and neck in said first side;

said cushion being of a height when supporting said human's head and neck to maintain said alignment of said spine with said head and neck of said human positioned on his side.

2. The therapeutic pillow as defined in claim 1 wherein said runners affixed along a bottom surface of said second cushion adjacent opposite edges thereof being elongated rectangular strips of a material adapted to provide said ridged structure each having a wide vertical longitudinal edge faced outward relative to a center position of said second cushion, an upper flat surface attached to said bottom surface of said second cushion, and a lower surface angled upwards to a narrow edge faced inwardly relative to said center position of said second cushion.

3. The therapeutic pillow as defined in claim 1 wherein said first side of said cushion is detachable from said second side of said cushion.

4. The therapeutic pillow as defined in claim 1 wherein said first runner and said second runner are strips of wood.

* * * * *